US009103037B2

(12) United States Patent
Parkos, Jr. et al.

(10) Patent No.: US 9,103,037 B2
(45) Date of Patent: Aug. 11, 2015

(54) METHOD FOR STRIPPING GAMMA-GAMMA PRIME COATING FROM GAMMA-GAMMA PRIME ALLOY

(75) Inventors: Joseph Parkos, Jr., East Haddam, CT (US); Curtis H. Riewe, Manchester, CT (US); Thomas M. Morin, Terryville, CT (US); Brian S. Tryon, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 938 days.

(21) Appl. No.: 13/223,667

(22) Filed: Sep. 1, 2011

(65) Prior Publication Data

US 2013/0059501 A1 Mar. 7, 2013

(51) Int. Cl.

| | |
|---|---|
| ***B24C 1/08*** | (2006.01) |
| ***C23F 1/44*** | (2006.01) |
| ***F01D 5/00*** | (2006.01) |
| ***C23F 1/28*** | (2006.01) |

(52) U.S. Cl.

CPC . *C23F 1/44* (2013.01); *B24C 1/086* (2013.01); *C23F 1/28* (2013.01); *F01D 5/005* (2013.01)

(58) Field of Classification Search

CPC ..... C23F 1/16; C23F 1/20; C23F 1/26; C23F 1/28; C23F 1/30; C23F 1/44; F05D 2230/80; F01D 5/005; B24C 1/086

USPC ..... 29/889.1; 134/3, 41; 216/102, 103, 108; 451/38, 39, 40, 53, 54

See application file for complete search history.

(56) References Cited

U.S. PATENT DOCUMENTS

| | | | | |
|---|---|---|---|---|
| 3,155,536 | A * | 11/1964 | Freeman, Jr. et al. | 427/310 |
| 4,089,736 | A * | 5/1978 | Fisher et al. | 216/103 |
| 4,176,433 | A * | 12/1979 | Lee et al. | 29/889.1 |
| 4,425,185 | A | 1/1984 | Fishter et al. | |
| 4,534,823 | A | 8/1985 | Fishter et al. | |
| 6,494,960 | B1 | 12/2002 | Macdonald et al. | |
| 7,875,200 | B2 | 1/2011 | Velez et al. | |
| 2005/0161438 | A1* | 7/2005 | Kool et al. | 216/102 |
| 2007/0023142 | A1* | 2/2007 | LaGraff et al. | 156/345.31 |
| 2007/0131255 | A1* | 6/2007 | Cox et al. | 134/28 |
| 2009/0252987 | A1 | 10/2009 | Greene, Jr. | |
| 2009/0301515 | A1 | 12/2009 | Rao et al. | |
| 2010/0089768 | A1 | 4/2010 | Jensen et al. | |

FOREIGN PATENT DOCUMENTS

EP 1050604 A1 11/2000

OTHER PUBLICATIONS

"T-066 Inspection Limits and Repair—Revision: A" TIMKEN Engineering, Aug. 27, 2009, pp. 1-11, XP002687399, Retrieved from the Internet: URL:http://www.timken.com/it-it/solutions/documents-%20250/T-066_Rev_A-.pdf, [retrieved on Nov. 16, 2012].

European Search Report, mailed Dec. 5, 2012.

* cited by examiner

*Primary Examiner* — Timothy V Eley

(74) *Attorney, Agent, or Firm* — Kinney & Lange, P.A.

(57) ABSTRACT

A method of stripping gamma/gamma prime polycrystalline alloy bond coats from single crystal gamma/gamma prime nickel based superalloys, including the steps of grit blasting followed by the use of hydrochloric acid solutions, followed by rinsing. The cycle may be repeated several times, with visual inspection between cycles.

17 Claims, 4 Drawing Sheets

| Coating No. 1 | | Al | Co | Cr | Hf | Si | Y | Zr | Ni |
|---|---|---|---|---|---|---|---|---|---|
| Tested ranges for chem strip (wt%) | max | 11.1 | 14.0 | 14.6 | 0.4 | 0.4 | 0.7 | 0.2 | Balance |
| | min | 7.5 | 11.0 | 9.7 | 0.1 | 0.1 | 0.2 | 0.1 | |

FIG. 2

| Coating No. 2 | | Al | Co | Cr | Hf | Mo | Si | Ta | W | Y | Zr | Ni |
|---|---|---|---|---|---|---|---|---|---|---|---|---|
| Tested ranges for chem strip (wt%) | max | 13.3 | 13.0 | 7.8 | 0.8 | 1.7 | 0.4 | 5.4 | 3.9 | 0.8 | 0.2 | Balance |
| | min | 8.6 | 10.0 | 5.4 | 0.2 | 1.1 | 0.1 | 2.6 | 2.6 | 0.3 | 0.1 | |

FIG. 3

METHOD FOR STRIPPING GAMMA-GAMMA PRIME COATING FROM GAMMA-GAMMA PRIME ALLOY

BACKGROUND

The present invention relates to removing a coating from a superalloy substrate. In particular, the invention relates to systems and methods for improving the removal of a coating from a superalloy substrate.

It is advantageous to provide gamma/gamma prime bond coats for nickel base superalloys of the gamma/gamma prime type because this type of coating has demonstrated greater spallation resistance over conventional gamma/beta systems. Gamma/gamma prime alloys are solid solutions of the alloy with intermetallic compounds as a second phase. However, gamma/gamma prime coating provides difficulties in stripping without damage to the substrate due to the close similarities of the coating and the base material.

During operation, the coatings suffer environmental damage and need to be periodically replaced or repaired to extend the life of the gas turbine hardware. Because of the corrosion and oxidation products that form on the surfaces, it is necessary to completely remove and reapply the coatings in selected areas before placing the component back in service. Mechanical means of removing the coatings such as abrasive blasting or machining are not preferred because of cost and the chance of harming the underlying substrate.

The method of choice for those experienced in the art is chemical removal (or chemical stripping) wherein the coating to be removed is exposed to a solution that weakens and eventually dissolves the coating. However, care must be taken to avoid damage to the base material if replacement is to be avoided.

SUMMARY

The present invention provides a method of stripping bond coats from nickel based superalloys that have been used in gas turbine engines, such as on turbine blades. The bond coats are gamma/gamma prime polycrystalline alloys, and the substrates are gamma/gamma prime single crystal alloys. The coatings are subjected to turbine operating conditions and in time need to be removed and replaced. The method includes grit blasting followed by the use of hydrochloric acid solutions, followed by rinsing. The cycle may be repeated several times, with inspection between cycles.

BRIEF DESCRIPTION OF THE DRAWINGS

FIG. 2 is a table showing the composition of coatings that were applied to a superalloy base bar.

FIG. 3 is a table showing the composition of different coatings that were applied to a superalloy base bar.

DETAILED DESCRIPTION

Figure 1:
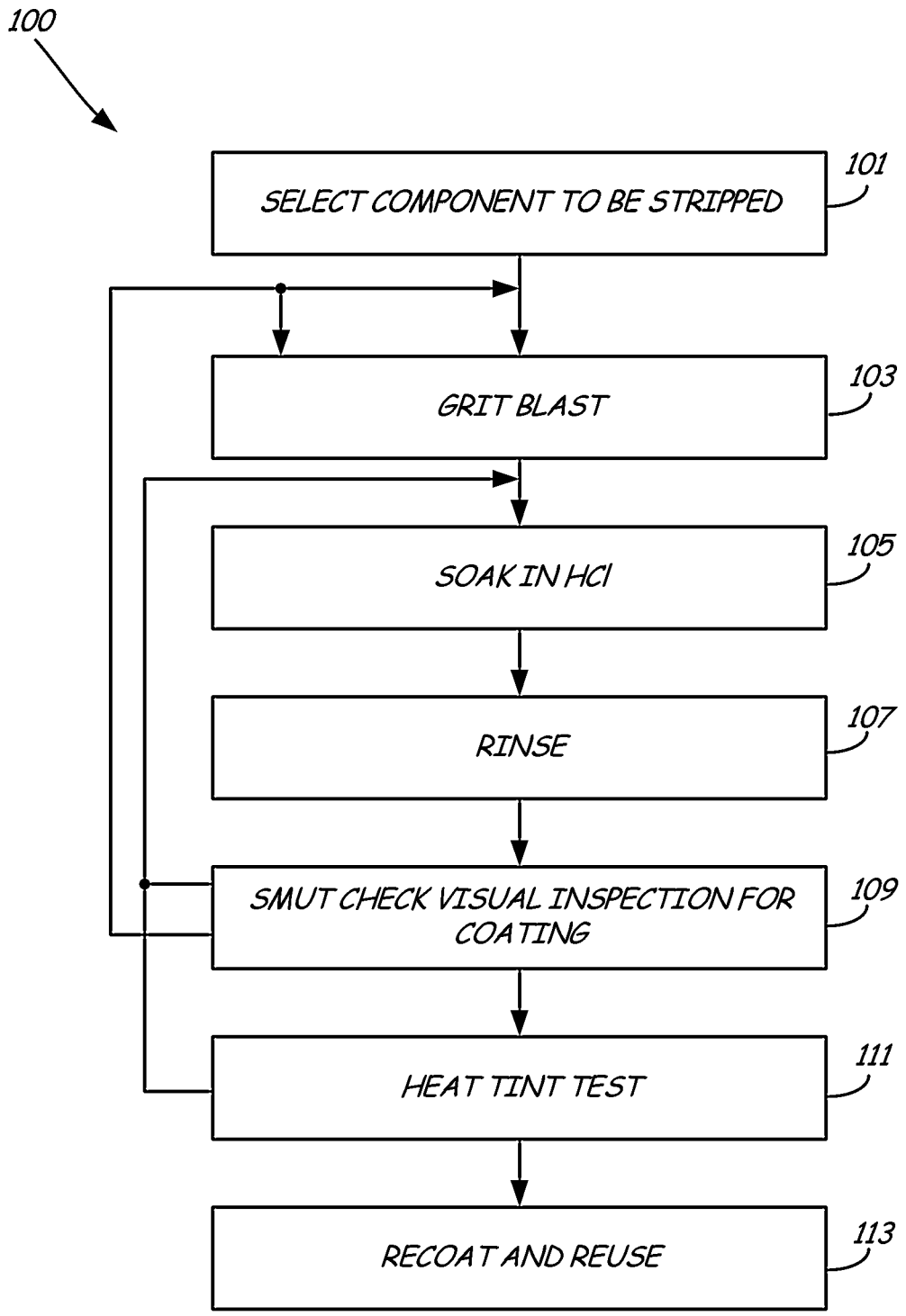
FIG. 1 illustrates the steps of removing a bond coat from a substrate used in gas turbine parts.

Method 100 for removing a bond coat from a substrate of a superalloy part is used to prepare the part for subsequent repair. First, an appropriate part needing repair is selected (Step 101). The part may be any of the many parts in gas turbine engines as well as other apparatus that are formed of superalloy metals and have a bond coat on their surfaces. Method 100 has been found to be effective, for example, on turbine air foils and stator vanes.

The selected part is grit blasted as a first step in removing the bond coat (Step 103). Grit blasting is intended to remove surface oxides and may be performed, for example, using 240 aluminum oxide. Good results have been obtained using 240 aluminum oxide particles at a pressure ranging from about 30 psi to about 60 psi for suction type machines. 240 aluminum oxide has a grit size of 240 on the ANSI Standards macro grade grit size.

The part is then placed in an agitated soak bath containing a high concentration of hydrochloric acid (HCl) in water (Step 105). The HCl concentration does not significantly affect the strip rate. Acceptable concentrations may range from 55% to 100% HCl. The part is then placed in the bath of HCl for a period of time, such as for about one to three hours. The bath temperature can be elevated and Step 105 is effective if the bath is at 150° F. (65.6° C.), though lower and higher temperatures of plus or minus 10° F. (5.5° C.) are also effective.

After the soaking has been completed, the part is removed and rinsed (Step 107). Care should be taken to avoid contact with the HCl when rinsing, as well as all other times. After the part is rinsed, it is inspected to see whether or not the coating has been removed. An effective inspection is a "smut check" (Step 109). A smut check involves placing the part in the acid solution of Step 105 for a short time, such as five minutes or so, followed by a visual inspection. The part without a coating will have a gun metal finish. If some or all of the part has a black or gray color, this is evidence that the coating or some of it remains. If it appears that some coating remains, as is normally the case after Step 105 has been performed only once, Step 105 is repeated for a period of time, such as an additional hour, including the smut check time of Step 109, followed by Step 107 and, once again, Step 109. In most instances the total number of hours of soak time may range from about three to about ten hours. Total soak times of six to nine hours have been found to be effective. No damage to the substrate was observed during the prescribed time for this process.

Alternatively, the repeat cycle may also include repeating Step 103 prior to Steps 105 and 107. The cycle of grit blast, soak in HCl and rinse is to be repeated until the smut check of Step 109 fails to show any dark color.

When Step 109 does not reveal smut, the part is then subjected to an additional inspection, which is a heat tint test (Step 111). The part is carefully removed, using white gloves or other non-contaminating devices and put in an air circulating oven. One effective air circulating oven is known as a Blue-M oven, which are available from Thermal Product Solutions in New Columbia, Pa. Hot air circulates over the part in Step 111. The temperature will be determined by the reaction of the part to the hot air as it will form oxides. The oxide color of the coating is different from the oxide color of the base alloy. Typically, the temperature may be 1050° F., ±25° F. (579.4° C.±13.9° C., although higher temperatures are also contemplated, such as 1300° F.±25° F. (704.4° C.±13.9° C.). After about an hour of Step 111, the part is again visually inspected. If the color is like flat gold or dusty brass, some coating remains, and Steps 105-111 are repeated. If the coating is removed, the base metal will have a violet or blue color. If the color of the stripped area is the same as the uncoated area, the part is stripped. A good comparison to determine if the coating is fully stripped is to compare the heat tinted surface of a previously coated area to an uncoated heat tinted surface on the same part. If those surfaces look similar then the coatings is stripped. The coated area will heat tint differently than the base metal. After heat tint confirms that the coating has been removed, the part is ready for further processing, which may include further repair and then recoating of the base coat, or, may only involve recoating. (Step 113). The part is then ready for reuse.

A number of experiments were performed using method 100 on different superalloy coated bars. Specifically, the coatings shown in FIGS. 2 and 3 were placed on a second generation nickel based superalloy. Bond coats such as those in FIGS. 2 and 3, as well as all others used in the present invention, are polycrystalline alloys. Polycrystalline alloys have grain boundaries at the point where each of the multitude of crystals forming the polycrystalline material so the process solution can dissolve the coating. In contrast, a single crystal alloy has no grain boundaries to be attached by the acid. The surface of the single crystal substrate material is the only grain boundary of that material. There are no short-circuit paths or surface area to attack with the process solution. It has been discovered that the method of this invention is capable of removing the coatings, using abrasion, heat, acid and rinses, of polycrystalline coatings on single crystal substrates without significantly affecting the substrate.

The specific test procedure included the following steps. All grit blasting was performed with 240 aluminum oxide at 45 psi in a suction cabinet. The soak solution was approximately 75% HCl in water at a temperature of 150° F. All heat tints were performed in an air circulating Blue-M oven at 1050° F.±25° F. for one hour.

Grit blast

Soak for one or more hours

Rinse to remove residue

Smut check

Repeat the grit blast, soak, rinse and smut check until the test indicates the coating has been removed.

Heat tint for one hour

Remove a section for metallographic review

Figure 4:
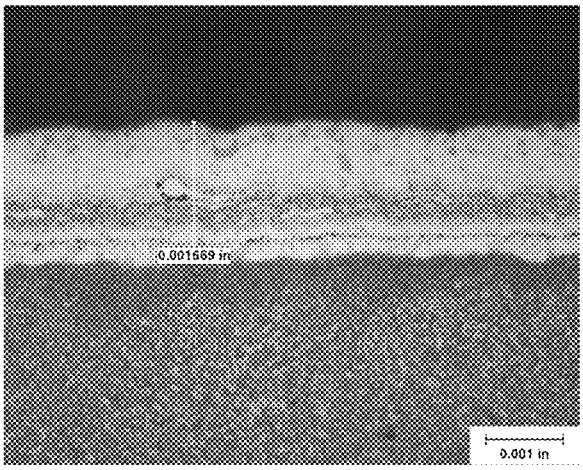
FIGS. 4 and 5 are microphotographs of a strip cycle over five hours total of the method of this invention on a first bond coat.
Figure 5:
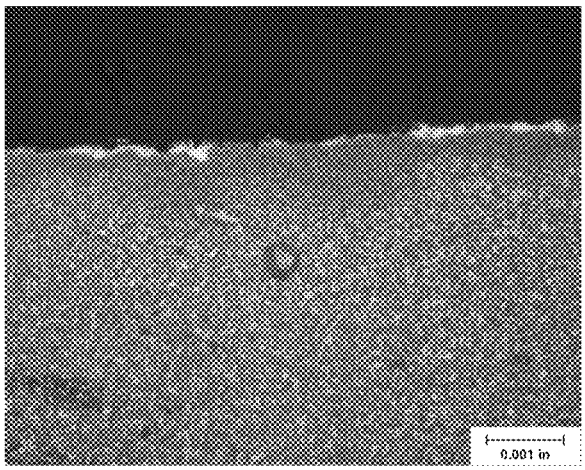

FIG. 4 shows a microphotograph of the surface of a coating having the composition shown in FIG. 3 on a second generation nickel-based alloy as identified above. FIG. 5 illustrates the result of treating after five hours of soaking using the strip cycles as set forth above. The surface is sufficiently cleared of bond coat that an additional grit blasting at most would be necessary to have the surface ready to use.

Figure 6:
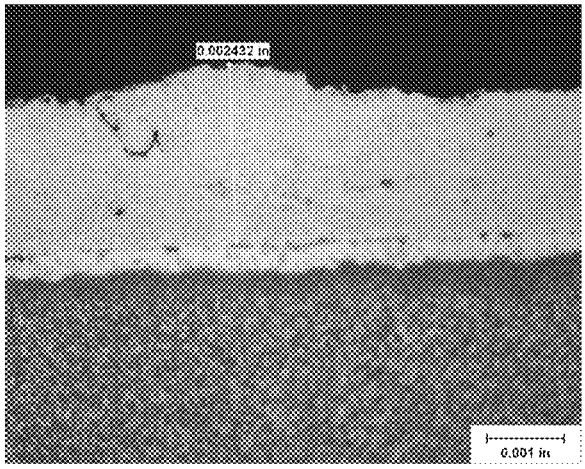
FIGS. 6 and 7 are microphotographs of a strip cycle over nine hours total of the method of this invention on a second bond coat.
Figure 7:
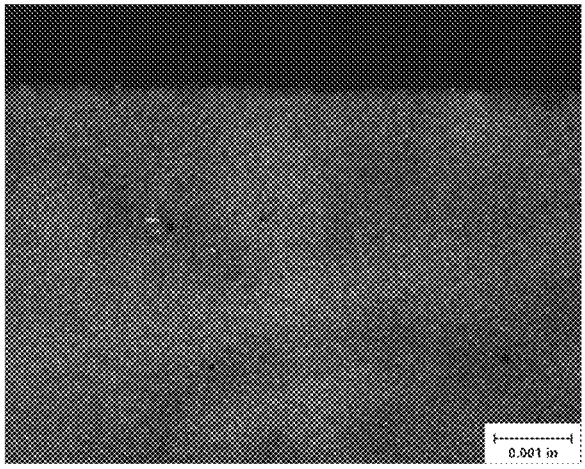

FIG. 6 shows a microphotograph of the surface of a coating having the composition shown in FIG. 2 on a second generation nickel-based alloy as identified above. FIG. 7 illustrates the result of treating after nine hours of soaking using the strip cycles as set forth above. The surface is sufficiently cleared of bond coat and no further treatment would be necessary to have the surface ready to use.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method comprising:

grit blasting a part that includes a polycrystalline super alloy bond coating on a single crystal, nickel superalloy base;

soaking the part in a concentrated hydrochloric acid solution of about 55% to about 100% hydrochloric acid at a temperature greater than room temperature for at least one hour;

rinsing the soaked part; and repeating the grit blasting, soaking and rinsing steps until inspection of the part determines the coating is removed.

2. The method of claim 1, wherein the grit blasting is performed with aluminum oxide grit.

3. The method of claim 2, wherein the aluminum oxide is 240 grit aluminum oxide.

4. The method of claim 3, wherein the grit blasting is done at a pressure of about 30 to about 60 psi.

5. The method of claim 1, wherein the hydrochloric acid solution is maintained at a temperature ranging between approximately 140° F. (60° C.) to 160° F. (71.1° C.).

6. The method of claim 1, wherein the inspection comprises a smut check in which the rinsed part is repositioned in the concentrated hydrochloric acid solution for a short period of time and removed, such that any remaining coating will be shown as a black or gray color on at least a portion of the part.

7. The method of claim 1, wherein the inspection comprises a heat tint check in which the rinsed part is placed in an air circulation oven for up to one hour at a temperature ranging between approximately 1050° F. (565.6° C.) to 1325° F. (718.3° C.).

8. The method of claim 1, wherein the coating is selected from a composition consisting by weight of approximately i) between 7.5 and 11.1 percent aluminum, 11.0 and 14.0 percent cobalt, 9.7 and 14.6 percent chromium, 0.1 and 0.4 hafnium, 0.1 and 0.4 percent silicon, 0.2 and 0.7 percent yttrium, 0.1 and 0.2 zirconium, and the balance nickel and ii) between 8.6 and 13.3 percent aluminum, 10.0 and 13.0 percent cobalt, 5.4 and 7.8 percent chromium, 0.2 and 0.8 percent hafnium, 1.1 and 1.7 percent molybdenum, 0.1 and 0.4 percent silicon, 2.6 and 5.4 percent tantalum, 2.6 and 3.9 percent tungsten, 0.3 and 0.8 yttrium, 0.1 and 0.2 zirconium, and the balance nickel.

9. The method of claim 1, wherein soaking the part in a concentrated hydrochloric acid solution totals a time ranging from about 5 to about 9 hours.

10. A method comprising:

grit blasting a polycrystalline super alloy bond coating on a single crystal, nickel superalloy base with aluminum oxide grit;

soaking the part in a concentrated hydrochloric acid solution of about 55% to about 100% hydrochloric acid at a temperature ranging between approximately 140° F. (60° C.) to 160° F. (71.1° C.) for at least one hour;

rinsing the soaked part; and repeating the grit blasting, soaking and rinsing steps until a visual inspection determines the coating is removed.

11. The method of claim 10, wherein the visual inspection comprises a smut check in which the rinsed part is repositioned in the concentrated hydrochloric acid solution for a short period of time and removed, such that a presence of any remaining coating will be shown as a black or gray color on at least a portion of the part.

12. The method of claim 10, wherein the visual inspection additionally comprises a heat tint check in which the rinsed part is placed in an air circulation oven for a time ranging between 45 minutes to one hour and 15 minutes at a temperature ranging between approximately 1050° F. (565.6° C.) to 1325° F. (718.3° C.).

13. The method of claim 10, wherein the coating is selected from a composition consisting of approximately by weight i) between 7.5 and 11.1 percent aluminum, 11.0 and 14.0 percent cobalt, 9.7 and 14.6 percent chromium, 0.1 and 0.4 hafnium, 0.1 and 0.4 percent silicon, 0.2 and 0.7 percent yttrium, 0.1 and 0.2 zirconium, and the balance nickel and ii) between 8.6 and 13.3 percent aluminum, 10.0 and 13.0 percent cobalt, 5.4 and 7.8 percent chromium, 0.2 and 0.8 percent hafnium, 1.1 and 1.7 percent molybdenum, 0.1 and 0.4 percent silicon, 2.6 and 5.4 percent tantalum, 2.6 and 3.9 percent tungsten, 0.3 and 0.8 yttrium, 0.1 and 0.2 zirconium, and the balance nickel.

14. The method of claim 10 wherein soaking the part in a concentrated hydrochloric acid solution totals a time ranging from about 4 to about 9 hours.

15. The method of claim 10 wherein soaking the part in a concentrated hydrochloric acid solution total a time ranging from about 5 to about 7 hours.

16. A method comprising:

grit blasting a part which includes a polycrystalline super alloy bond coat having the composition selected from a coating consisting of approximately by weight i) between 7.5 and 11.1 percent aluminum, 11.0 and 14.0 percent cobalt, 9.7 and 14.6 percent chromium, 0.1 and 0.4 hafnium, 0.1 and 0.4 percent silicon, 0.2 and 0.7 percent yttrium, 0.1 and 0.2 zirconium, and the balance nickel and ii) between 8.6 and 13.3 percent aluminum, 10.0 and 13.0 percent cobalt, 5.4 and 7.8 percent chromium, 0.2 and 0.8 percent hafnium, 1.1 and 1.7 percent molybdenum, 0.1 and 0.4 percent silicon, 2.6 and 5.4 percent tantalum, 2.6 and 3.9 percent tungsten, 0.3 and 0.8 yttrium, 0.1 and 0.2 zirconium, and the balance nickel, the coating being on a single crystal, nickel superalloy base, wherein the grit blasting uses 240 aluminum oxide grit and is done at a given pressure;

soaking the part in a concentrated hydrochloric acid solution of about 55% to about 100% acid in water at a temperature ranging between approximately 140° F. (60° C.) to 160° F. (71.1° C.) for at least one hour;

rinsing the soaked part; and repeating the grit blasting, soaking and rinsing steps, wherein soaking totals a time ranging from about 6 to 9 hours, until inspection of the part determines the coating is removed.

17. The method of claim 15, wherein inspection of the part further comprises a heat tint check in which the rinsed part is placed in an air circulation oven for up to one hour at a temperature ranging between approximately 1025° F. (551.7° C.) to 1325° F. (718.3° C.).

* * * * *